US009237783B2

(12) United States Patent
La Rocca et al.

(10) Patent No.: US 9,237,783 B2
(45) Date of Patent: Jan. 19, 2016

(54) SLIDE FASTENER

(71) Applicant: YKK Corporation, Tokyo (JP)

(72) Inventors: Giovanni La Rocca, Vercelli (IT); Gabriele Biava, Vercelli (IT); Piero Masserano, Varcelli (IT)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/359,927

(22) PCT Filed: Nov. 22, 2012

(86) PCT No.: PCT/IB2012/056623
§ 371 (c)(1),
(2) Date: May 22, 2014

(87) PCT Pub. No.: WO2013/076678
PCT Pub. Date: May 30, 2013

(65) Prior Publication Data

US 2014/0304954 A1 Oct. 16, 2014

(30) Foreign Application Priority Data

Nov. 22, 2011 (IT) ..... TO2011A1070

(51) Int. Cl.
*A44B 19/32* (2006.01)
*A44B 19/26* (2006.01)
(Continued)

(52) U.S. Cl.
CPC ..... *A44B 19/26* (2013.01); *A44B 19/08* (2013.01); *A44B 19/32* (2013.01); *A44B 19/34* (2013.01); *A44B 19/10* (2013.01); *Y10T 24/2514* (2015.01)

(58) Field of Classification Search
CPC ..... A44B 19/08; A44B 19/10; A44B 19/26; A44B 19/32; A44B 19/34; A44B 19/40; Y10T 24/2514; Y10T 24/2591; Y10T 24/25; Y10T 24/2529; Y10T 24/2504; Y10T 24/252; Y10T 24/253; Y10T 24/2539
USPC ..... 24/387, 383, 389, 398, 415, 432, 433
See application file for complete search history.

(56) References Cited

U.S. PATENT DOCUMENTS 3,501,816 A * 3/1970 Heimberger ..... 24/389
3,685,103 A * 8/1972 Severino ..... 24/381

(Continued)

FOREIGN PATENT DOCUMENTS

CN 1272346 A 11/2000
DE 19924539 A1 11/2000

(Continued)

OTHER PUBLICATIONS

Office Action, Taiwanese Patent Application No. 101143777, mailed Sep. 9, 2014.

(Continued)

*Primary Examiner* — Robert J Sandy
*Assistant Examiner* — David Upchurch
(74) *Attorney, Agent, or Firm* — Kilpatrick Townsend & Stockton LLP

(57) ABSTRACT

The slide fastener includes a pair of stringers, each including a flexible tape having first and second sides facing in opposite directions, and outer and inner longitudinal edges, and coupling elements attached to the first side of the tape, for engagement with corresponding coupling elements of the tape of the other stringer. In the disengaged condition of the coupling elements, inner longitudinal edge portions of the stringers project beyond the respective coupling elements toward the other stringer, to an extent such that when the coupling elements are engaged with each other, the inner longitudinal edge portions of the stringers are engaged with one another in a substantially overlapped condition.

12 Claims, 5 Drawing Sheets

(51) Int. Cl.

| | |
|---|---|
| ***A44B 19/08*** | (2006.01) |
| ***A44B 19/34*** | (2006.01) |
| *A44B 19/10* | (2006.01) |

(56) References Cited

U.S. PATENT DOCUMENTS

| | | | | |
|---|---|---|---|---|
| 4,580,321 | A * | 4/1986 | Tanikawa et al. | 24/389 |
| 4,596,065 | A * | 6/1986 | Tanikawa et al. | 29/408 |
| 4,601,085 | A * | 7/1986 | Yoshida et al. | 24/384 |
| 4,607,416 | A * | 8/1986 | Tanikawa et al. | 24/389 |
| 4,724,586 | A * | 2/1988 | Tsubokawa et al. | 24/384 |
| 5,181,299 | A * | 1/1993 | Huang | 24/432 |
| 5,386,616 | A * | 2/1995 | Norvell | 24/389 |
| 6,343,408 | B1 | 2/2002 | Neugebauer | |
| 6,427,294 | B1 | 8/2002 | Shibaike et al. | |
| 7,293,333 | B2 | 11/2007 | Stenhäll | |
| 2006/0010660 | A1 * | 1/2006 | Stenhall | 24/389 |
| 2008/0189918 | A1 * | 8/2008 | Kusayama | 24/389 |
| 2011/0005042 | A1 | 1/2011 | Thomas | |

FOREIGN PATENT DOCUMENTS

| | | | |
|---|---|---|---|
| EP | 2274997 | A2 | 1/2011 |
| WO | 2004/039199 | A1 | 5/2004 |
| WO | 2004/100695 | A1 | 11/2004 |
| WO | 2009/068848 | A2 | 6/2009 |

OTHER PUBLICATIONS

International Search Report, PCT Application No. PCT/IB2012/056623, mailed Jan. 25, 2013.

* cited by examiner

SLIDE FASTENER

This application is a national stage application of PCT/IB2012/056623 which claims priority to Italian Patent Application No. TO2011A001070, both of which are incorporated herein by reference.

TECHNICAL FIELD

The present invention relates to a slide fastener.

BACKGROUND

A type of related-art slide fastener comprises a pair of stringers, each including a flexible tape having first and second sides facing in opposite directions, and outer and inner longitudinal edges, and coupling elements attached to the first side of the tape, for engagement with corresponding coupling elements provided on the first side of the tape of the other stringer.

In such prior slide fasteners a continuous coil-like coupling element is affixed to one side of the stringer tapes. In the closed condition of such fasteners the tapes are merely juxtaposed and the gap therebetween remains visible, with possible problems from an aesthetic point of view. Said gap can also pose problems in certain applications wherein at least some degree of water-tightness is desired or necessary.

SUMMARY

An object of the present invention is to provide an improved slide fastener of the previously defined kind, which allows the limitations and inconveniences of the prior art slide fasteners to be overcome.

This and other objects are achieved according to the present invention by a slide fastener of the initially defined kind, characterized in that in the disengaged condition of said coupling elements, inner longitudinal edge portions of the stringers project beyond the respective coupling elements, toward the other stringer, to an extent such that when the coupling elements are engaged with each other, said inner longitudinal edge portions of the stringers are engaged with one another in a substantially overlapped condition.

In certain embodiments, in the overlapped condition the inner longitudinal edge portions of the stringers are superimposed one on the other, in a plane essentially parallel to the stringers.

In other embodiments, in the overlapped condition said inner longitudinal edge portions of the stringers are abutted one against the other in a plane essentially orthogonal to the stringers.

In certain embodiments a water-tight coating, in particular of a polymer material, such as a polyurethane, is applied on said first side of the tapes.

According to another aspect of the present invention, a further coating of a water-tight material, in particular a polymer material, may be provided on the second side of the tapes.

In an embodiment the arrangement is such that in the above-defined overlapped condition a water-tight coating on the first side of one tape is superimposed to the further water-tight coating provided on the second side of the other tape.

BRIEF DESCRIPTION OF DRAWINGS

Further characteristics and advantages of the present invention will become apparent from the following description provided merely by way of non-limiting examples, with reference to the drawings, wherein.

EMBODIMENTS

Figure 1:
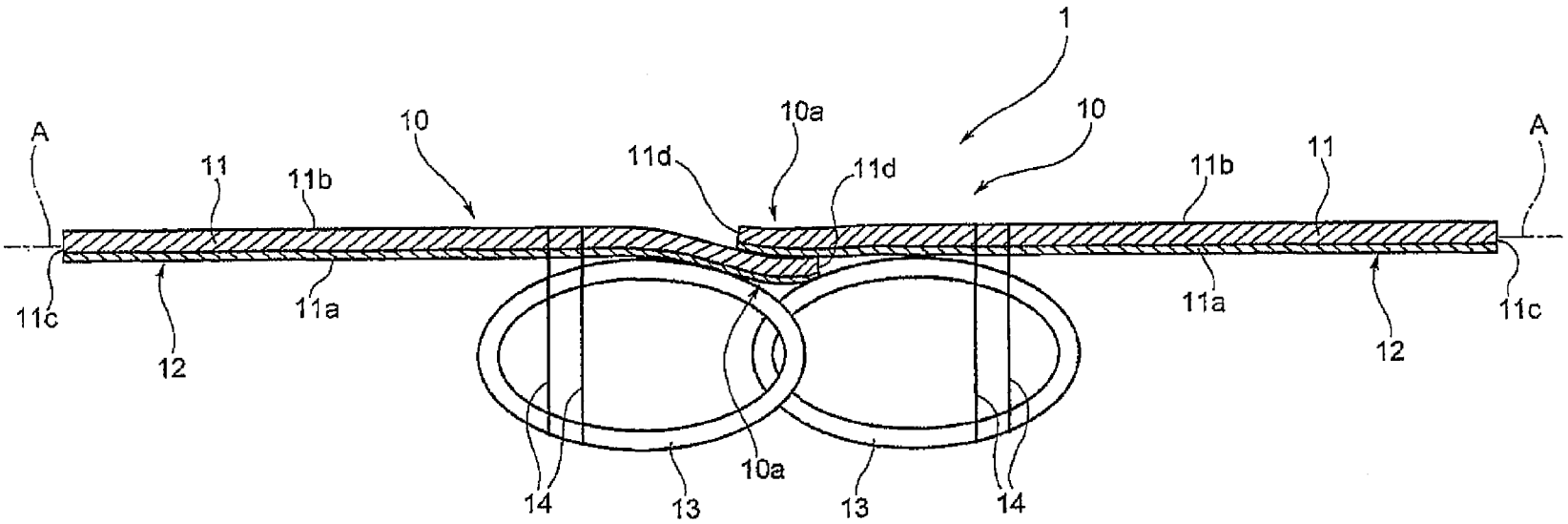
FIG. 1 is a schematic transverse cross-sectional view of stringers of a slide fastener according to the invention, showing the same in a first, partially overlapped condition.
Figure 2:
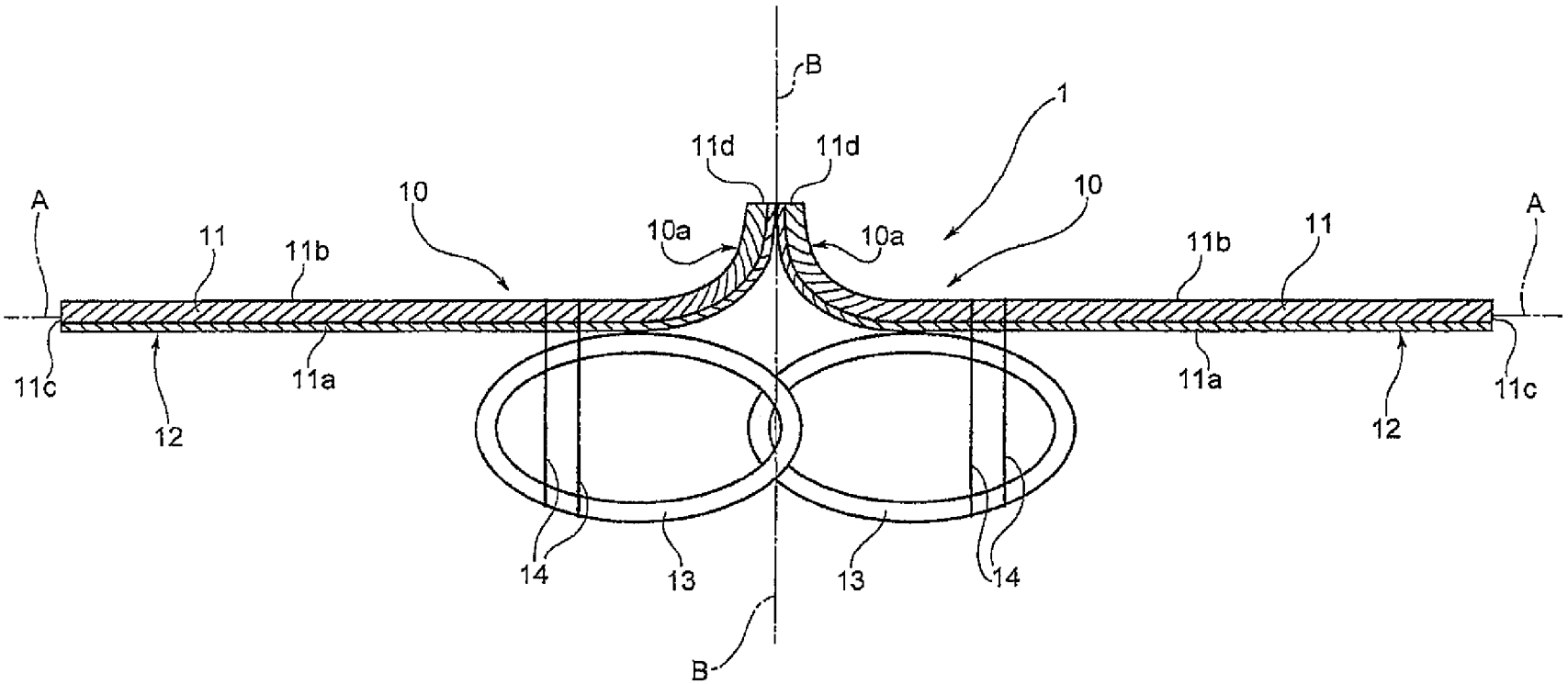
FIG. 2 is a schematic transverse cross-sectional view of the stringers illustrated in FIG. 1, showing the same in a second, overlapped condition.

In FIGS. 1 and 2 a slide fastener according to the present invention is generally indicated 1. In the following description, a vertical direction (an up and down direction) and a horizontal direction (a right and left direction) of the slide fastener 1 are determined with reference to FIG. 1. An upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. In addition, a longitudinal direction is a direction perpendicular to the paper surface of FIG. 1.

The slide fastener 1 comprises a pair of right and left fastener stringers 10, which are substantially mirror images of each other and lie in a general plane indicated A-A. The plane A-A is substantially parallel with the stringers 10.

Each stringer 10 comprises a flexible fabric. A tape having a width of 12 to 16 mm is preferably used as the fabric, but the fabric may be a fabric which directly constitute a garment, a bag, or an article such as cover etc. Hereinafter, a tape 11 will be described as an example of the fabric. The tape 11 has first and second sides 11*a*, 11*b* facing in opposite directions, and outer and inner edges 11*c*, 11*d* extending in the longitudinal direction. In the illustrative embodiment shown in the drawings, the first side 11*a* is located at the lower side of the tape 11 and the second side 11*b* is located at the upper side of the tape 11. The inner edge 11*d* means an edge located at a side close to the opposing tape 11. The outer edge 11*c* means an edge located at the opposite side opposite of the inner edge 11*d* and located at a side away from the opposing tape 11.

The tapes 11 can be woven or knitted or made of non-woven fabrics or laminates, and the like.

A coating layer 12 of a water-tight material can be provided on the first side 11*a* of each tape 11.

Such a coating may be conveniently made of a polymer material, and can be laminated onto the respective tape.

As an alternative, the coating 12 can be applied onto the first side 11*a* of the tapes 11 by other known methods, for instance by a plasma-spraying technique.

The tapes 11 can have a thickness of, for instance, about 0.3 mm, and the coating layers 12 possibly applied thereto are in general much thinner, their thickness being for instance of about 0.05 mm.

To the same first side 11*a* of the tapes 11 possibly provided with the coating layer 12 there are attached, for instance by sewing, respective coupling elements 13, of a per se known kind.

The coupling elements 13 are in particular continuous, coil-like coupling elements, securely stitched to the tapes 11 by means of threads 14. The right and left coupling elements are configured to engage with or disengaged from each other. In the illustrative embodiments as shown in the drawings, the coupling elements 13 are located at the lower side of the tape 11.

Figure 4:
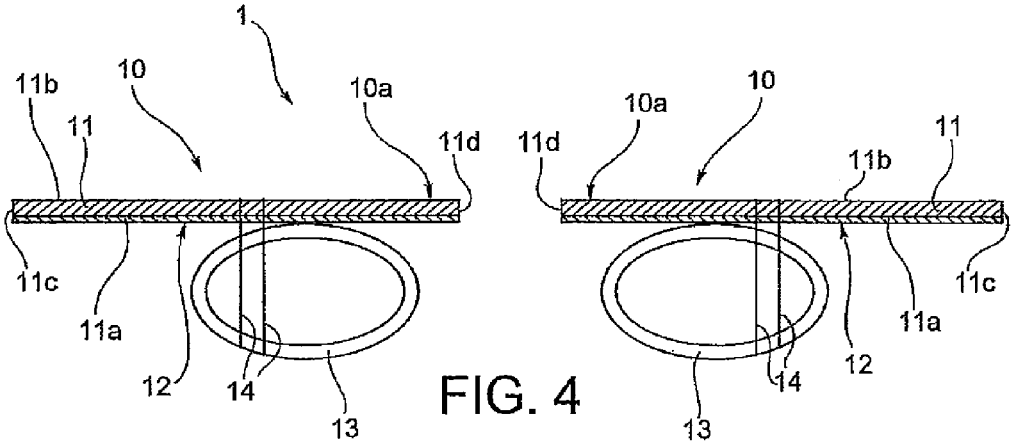

FIG. 4 shows a slide fastener as described above, illustrated in the open condition, i.e. in the mutually disengaged condition of the coupling elements 13.

As it can be seen in that figure, in the open condition of the slide fastener 1 the inner longitudinal edge portions 10*a* of the stringers 10 project beyond the respective coupling elements 13, toward the other stringer in the right and left direction.

The extent by which said edge portions 10*a* of the stringers 10 extend beyond the respective coupling elements 13 is such that when elements 13 are engaged with each other, as shown in FIGS. 1 and 2, the edge portions 10*a* are engaged with one another in a substantially overlapped condition.

Referring again to FIG. 1, in the above-mentioned overlapped condition the longitudinal edge portions 10*a* of the stringers 10 can be simply superimposed one on the other along a plane essentially parallel to the stringers 10. That is, the longitudinal edge portions 10*a* of the stringers 10 face each other in the up and down direction.

Referring to FIG. 2, in said overlapped condition the inner longitudinal edge portions 10*a* of the stringers 10 can be abutted one against the other, in a plane B-B essentially orthogonal to the plane A-A of the stringers 10. That is, the longitudinal edge portions 10*a* of the stringers 10 face each other in the right and left direction.

Although with a conventional slider of a known design (not shown) the edge portions 10*a* of the stringers 10 are more likely to become overlapped as shown in FIG. 1, if desired such a slider can be easily arranged such as to ensure that the edge portions 10*a* of the stringers are overlapped as shown in FIG. 2.

It is however possible that, depending on various parameters, and in particular on the instantaneous conditions of use, a same fastener may assume in the closed condition either the configuration shown in FIG. 1 or the configuration shown in FIG. 2.

In both the above described configurations, in the closed condition the slide fastener 1 is substantially water-tight, particularly if the stringer tapes 11 are provided with respective coating layers 12.

In the configuration shown in FIG. 1 the water-tight coating 12 of the upper stringer abuts against the tape 11 of the lower stringer, and hinders the penetration of water from above to below the fastener, and vice versa, whereas in the configuration shown in FIG. 2 the water-tight coating layers 12 of the two stringers abut one against the other like two sealing lips, hindering the penetration of water, in particular from above to below the slide fastener.

Anyway, even in the absence of the coating layers 12, the slide fastener 1 according to the invention provides a certain degree of water-tightness thanks to the overlap of the inner longitudinal edge portions of the stringers thereof.

The extent by which the longitudinal inner edge portions 10*a* of the stringers 10 project over the respective coupling elements 13 can be sized such that the overlapped condition of FIG. 1 or FIG. 2 are still maintained when, in use, the stringers 10 are subjected to tensile stresses tending to tear them one apart from the other.

Figure 5:
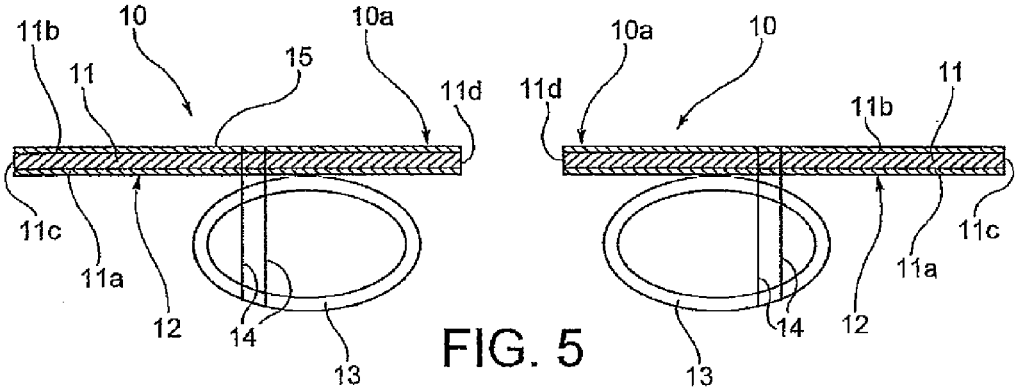

In FIG. 5 there is shown a variant wherein a further coating layer 15 of a water-tight material, in particular a polymeric material, is provided on the second side 11*b* of the tapes 11.

In that case the arrangement is such that, in the overlapped condition described above in connection with FIG. 1, the water-tight coating 12 on the first side 11*a* of one tape 11 is superimposed on the further water-tight coating 15 provided on the second side 11*b* of the other tape 11.

Such a configuration enhances the water-tightening effect when the slide fastener 1 is closed.

The thickness of the further coating layer 15 is conveniently of the same order of magnitude as the layer 12.

Figure 3:
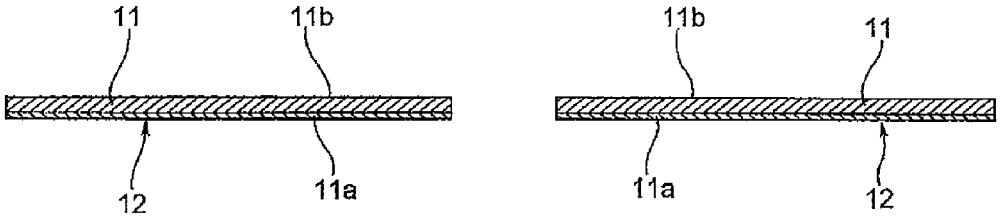
FIGS. 3 to 5 are schematic transverse cross-sectional views showing successive steps of a method for the manufacture of stringers for a slide fastener according to the present invention.

The slide fastener 1 described above can be manufactured by the method which will be now disclosed with particular reference to FIGS. 3 to 5.

In a first step shown in FIG. 3 the tapes 11 are provided each with a respective water-tight coating layer 12, if desired.

This can be accomplished by any of the known techniques, for instance by lamination or plasma-spraying.

In connection therewith it is noted that in preparing the tapes 11, the inner longitudinal edges 11*d* thereof may be conveniently sealed to protect them against fraying caused in use by the repeated use of the slider in opening and closing the slide fastener.

Where the tapes 11 comprise meltable yarns or fabric, and/or have been provided with one or more polymeric films, the inner longitudinal edges 11*d* thereof can be sealed for instance by means of a sonic blade.

As shown in FIG. 4, in a subsequent method step a pair of coupling elements 13 are affixed to the right and left tapes 11, on the respective side thereof which has been possibly provided with the water-tight coating 12.

The coupling elements 13 are affixed to the tapes 11, at respective distances from the outer edges 11*c* thereof.

In a subsequent step, if desired, a respective further coating layer 15 of a water-tight material is applied onto the second side 11*b* of the tape 11, as shown in FIG. 5.

Such a further coating layer 15 contributes to the overall water-proofing effect and in particular prevents leakages of water through the stitches by which the couplings 13 are affixed to the stringers 10.

Figure 6:
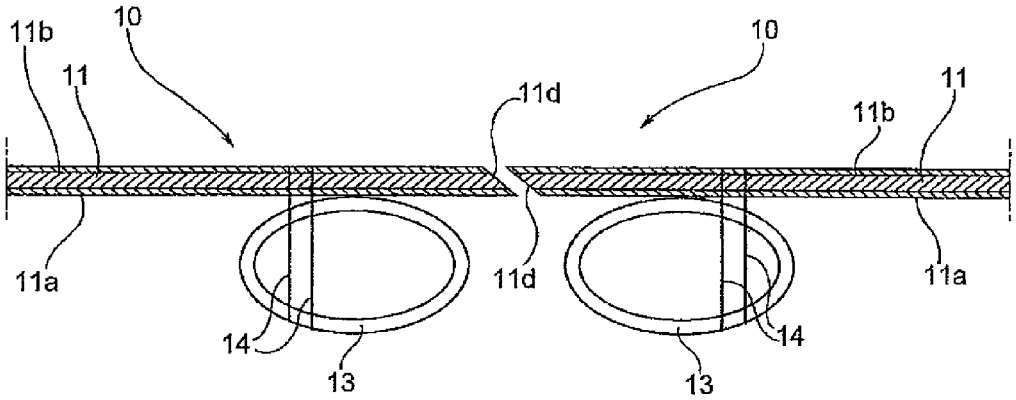
FIGS. 6 and 7 are schematic transverse cross-sectional views showing another fastener according to the invention in the open condition and in the closed condition, respectively.

The innermost edges 11*d* of the tapes 11 may be slanted, as shown in FIG. 6, though being at least approximately parallel with one another.

Figure 7:
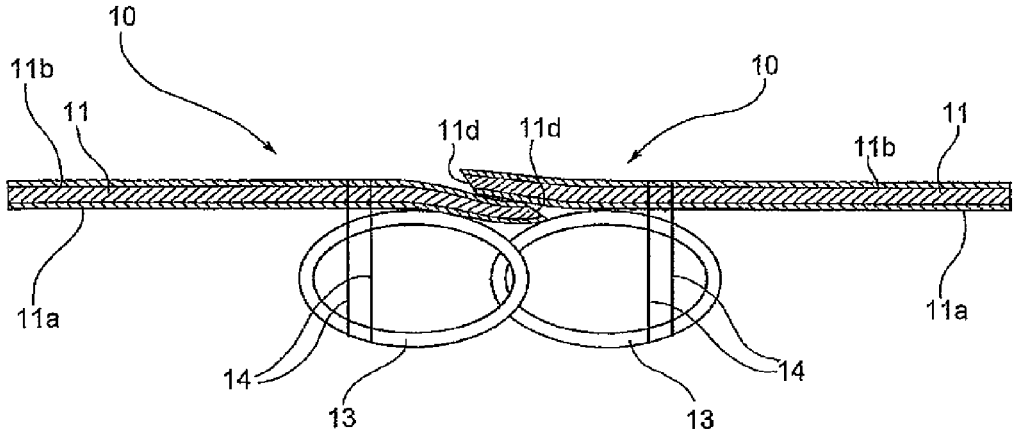

In consequence of such a slanted cut, when the slide fastener 1 is closed the inner longitudinal edge portions 10*a* of the resulting stringers 10 are more likely to be overlapped in the manner shown in FIG. 7, which substantially corresponds to the same kind of overlapped configuration described above in connection with FIG. 1.

The stringers 10 can be provided with the usual accessories, like a slider, end stops, etc., typical of slide fasteners.

Figure 8:
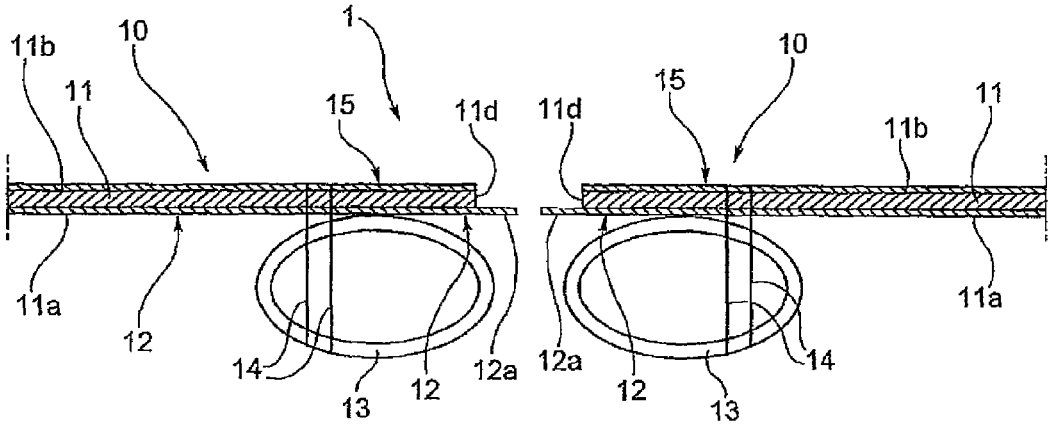
FIG. 8 is a schematic transverse cross-sectional view showing an alternative embodiment.
Figure 9:
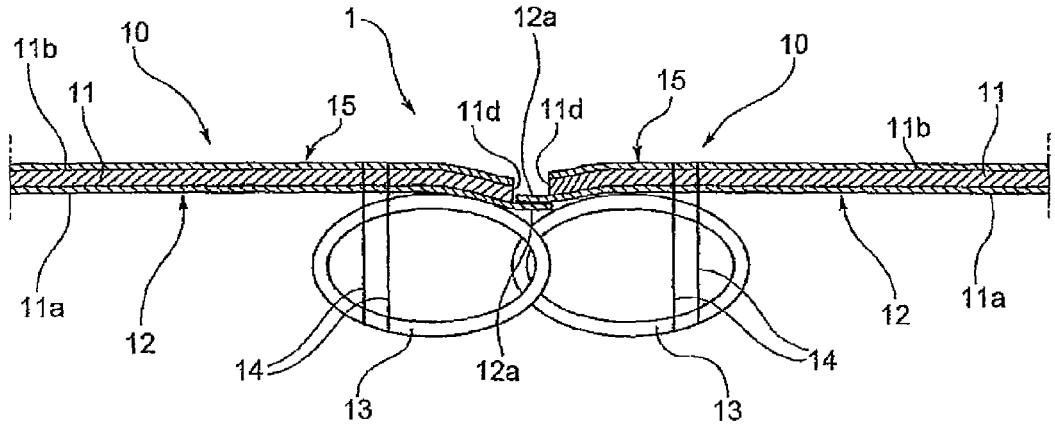
FIG. 9 is a transverse cross-sectional view showing the stringers of FIG. 8 in an overlapped condition of use.

FIGS. 8 and 9 show a further embodiment.

In said figures parts and components which have already been described in connection with the preceding figures have been attributed again the same reference numerals used previously.

In the embodiment according to FIGS. 8 and 9 the water-tight coating 12 provided on the first side 11*a* of each tape 11 has an inner edge portion 12*a*, which projects beyond the inner edge 11*d* of the corresponding tape 11. Furthermore, the arrangement is such that in the closed condition of the fastener 1, shown in FIG. 9, basically only said inner edge portions 12*a* of the coating layers 12 are overlapped with one another, thus forming a double barrier preventing penetration of water from one side of the slide fastener to the other.

Slide fasteners according to the present invention can be attached to pieces of apparel or other articles such that the coupling elements 13 face toward the lower side or, if preferred, toward the upper side.

In the former case, the coupling elements are barely discernible in the exterior appearance of a component of the garment or the other article when the slide fastener is closed.

Naturally, the principle of the invention remaining the same, various variants and modifications can be envisaged by the persons skilled in this art, without thereby departing from the scope of the invention, which is ultimately defined in the appended claims.

The invention claimed is:

1. A slide fastener comprising a pair of stringers, each comprising:

a flexible tape having first and second sides facing in opposite directions, and outer and inner longitudinal edges; and coupling elements attached to the first side of the tape, for engagement with corresponding coupling elements of the tape of the other stringer, wherein in a disengaged condition of the coupling elements, inner longitudinal edge portions of the stringers project beyond the respective coupling elements toward the other stringer, to an extent such that when the coupling elements of the stringers are engaged with each other, the inner longitudinal edge portions of the stringers are engaged with one another in a substantially overlapped condition, wherein in the overlapped condition the inner longitudinal edge portions of the stringers are superimposed along a plane essentially parallel to the stringers, and wherein each stringer comprises a coating of a water-tight material applied onto the first side of the tape.

2. A slide fastener comprising a pair of stringers, each comprising:

a flexible tape having first and second sides facing in opposite directions, and outer and inner longitudinal edges; and coupling elements attached to the first side of the tape, for engagement with corresponding coupling elements of the tape of the other stringer, wherein in a disengaged condition of the coupling elements, inner longitudinal edge portions of the stringers project beyond the respective coupling elements toward the other stringer, to an extent such that when the coupling elements of the stringers are engaged with each other, the inner longitudinal edge portions of the stringers are engaged with one another in a substantially overlapped condition, wherein in the overlapped condition the inner longitudinal edge portions of the stringers are abutted one against the other, in a plane essentially orthogonal to the stringers, and wherein each stringer comprises a coating of a water-tight material applied onto the first side of the tape.

3. The slide fastener according to claim 1, wherein a further coating of a water-tight material is provided on the second side of each tape.

4. The slide fastener according to claim 3, wherein in the overlapped condition the water-tight coating on the first side of one tape is superimposed onto the further water-tight coating provided on the second side of the other tape.

5. The slide fastener according to claim 2, wherein in the overlapped condition of the inner longitudinal edge portions of the stringers the water-tight coating of one stringer abuts against the water-tight coating of the other stringer.

6. The slide fastener according to claim 1, wherein the inner longitudinal edges of the tape have slanted end surfaces.

7. A slide fastener comprising a pair of stringers, each comprising:

a flexible tape having first and second sides facing in opposite directions, and outer and inner longitudinal edges; and coupling elements attached to the first side of the tape, for engagement with corresponding coupling elements of the tape of the other stringer, wherein in a disengaged condition of the coupling elements, inner longitudinal edge portions of the stringers project beyond the respective coupling elements toward the other stringer, to an extent such that when the coupling elements of the stringers are engaged with each other, the inner longitudinal edge portions of the stringers are engaged with one another in a substantially overlapped condition, wherein each stringer comprises a coating of a water-tight material applied onto the first side of the tape, and wherein the water-tight coating on the first side of each tape projects beyond the inner longitudinal edge of the corresponding tape.

8. The slide fastener according to claim 1, wherein the inner longitudinal edges of the tape have been sealed against fraying.

9. The slide fastener according to claim 2, wherein the inner longitudinal edges of the tape have been sealed against fraying.

10. The slide fastener according to claim 2, wherein a further coating of a water-tight material is provided on the second side of each tape.

11. The slide fastener according to claim 1, wherein the coupling elements are attached to the first side of the tape on which the water-tight coating is applied, by threads and the threads pass through the water-tight coating.

12. The slide fastener according to claim 2, wherein the coupling elements are attached to the first side of the tape on which the water-tight coating is applied, by threads and the threads pass through the water-tight coating.

* * * * *